US005823414A

United States Patent [19]

Gal et al.

[11] Patent Number: 5,823,414

[45] Date of Patent: Oct. 20, 1998

[54] SYSTEM FOR CARRYING ARTICLES ON ONE'S BACK

[75] Inventors: Yann Le Gal, Isere; André Finot, Drome, both of France

[73] Assignee: Lafuma SA, France

[21] Appl. No.: 844,265

[22] Filed: Apr. 18, 1997

[30] Foreign Application Priority Data

Apr. 19, 1996 [FR] France ..... 96 05194

[51] Int. Cl.[6] ..... A45F 3/04

[52] U.S. Cl. ..... 224/637; 224/636; 224/634; 224/262

[58] Field of Search ..... 224/153, 625–641, 224/259–262

[56] References Cited

U.S. PATENT DOCUMENTS

| | | | |
|---|---|---|---|
| 4,049,164 | 9/1977 | Sullivan et al. | 224/635 |
| 5,704,530 | 1/1998 | Scherer | 224/634 |
| 5,732,867 | 3/1998 | Perkins et al. | 224/628 |

FOREIGN PATENT DOCUMENTS

| | | | |
|---|---|---|---|
| 476398 | 8/1951 | Canada | 224/211 |
| 0158154 | of 1985 | European Pat. Off. . | |
| 0518485 | of 1992 | European Pat. Off. . | |
| 2700252 | of 1994 | France . | |
| 2700677 | of 1994 | France . | |
| 106297 | 1/1943 | Germany | 224/210 |
| 295 09 183 | of 1995 | Germany . | |
| 43 39 189 | of 1995 | Germany . | |
| 9105494 | 5/1991 | WIPO | 224/213 |

*Primary Examiner*—Allan N. Shoap
*Assistant Examiner*—Gregory M. Vidovich
*Attorney, Agent, or Firm*—Wall Marjama & Bilinski

[57] ABSTRACT

A system for carrying articles on one's back consists of a load carrier (1) integral with a back part of a carrying harness including a waist strap (3) and shoulder straps fastened to the bottom (9) and to the top of the back part. The system also includes a U-shaped rigid frame fastened to the back part. Preferably, the free ends of the U-shaped frame are retained in a rear face of the waist strap. A pair of spacers having an inverted V-shape interconnect the waist strap and the bottom of the back part and define a ventilation space for the sweat of the wearer. Preferably, the system is designed for an ergonomic backpack.

8 Claims, 5 Drawing Sheets

SYSTEM FOR CARRYING ARTICLES ON ONE'S BACK

FIELD OF THE INVENTION

The invention relates to a system for carrying articles on one's back. It relates more particularly to an improved backpack, back-held child carrier, rack or satchel.

However, in the remainder of the description, the invention will be described more particularly, in terms of its preferred "backpack" application.

BACKGROUND OF THE INVENTION

As is known, a backpack essentially comprises three distinct parts, i.e.:

firstly, an actual bag which is intended to receive the load;

a back part adjoined to this bag, usually thermoformed;

and, finally, a carrying harness which includes two shoulder straps fastened to the top and to the bottom of the back part, and a waist strap.

The back part advantageously includes a rigid frame, in the form of an inverted U, formed from two bent branches fastened to the back part of the bag, at the top via the portion connecting the two branches of the U and to the bottom of the back part by interacting with the waist strap, respectively.

As is known, while being carried, the back part of the bag presses against the carrier's back which, because of the effort involved, sweats. Unfortunately, this sweat is eliminated poorly or is not eliminated at all. Therefore, when the bag is removed, the carrier's back is frequently wet, which gives rise to risks of chilling and creates an uncomfortable sensation.

Until recently, when making backpacks, efforts were made to reconcile two objectives which, in practice, proved poorly compatible, i.e. adaptation to the morphology of the carrier, ergonomics, and comfort during use. Ergonomics, i.e. the appearance of the morphology of the carrier's back, are achieved by using a thermoformed back part which matches the form of the carrier's back, coming into contact with it. However, the fact that the area of contact with the carrier's back is large considerably accelerates the sweating phenomena.

It was then proposed, during thermoforming, to provide bent channels in the back part, to ventilate the latter. These channels, which form a succession of elongate padding pieces, proved quite inadequate for ventilating the carrier's back and totally ineffectual in terms of ventilation.

In document EP-A-0158 154, it was suggested that a mesh-type support net be placed between the rear of the waist strap and a laterally projecting spacing part connecting the upper end of the vertical branches of the rigid frame, said spacing part being in turn covered with an elastic support band. Although put into use, this solution has the disadvantage of involving a loss of volume in the bag and insufficient ventilation at the bottom of the back part, at hip level, particularly as a result of the supports at this level.

In document FR-A-2 700 252, the Applicant suggested making a plurality of upward-running facing parallel channels, open at their end, in the back part, the outer side of these channels being covered with a mesh-type sheet designed to come into contact with the carrier's back. Although this solution is satisfactory in terms of ventilation, it is nevertheless complicated and therefore expensive.

In Patent EP-A-0 518 485, it was proposed that a bevelled plastic foam support piece be interposed, in the lumbar region, between the rear of the waist strap and the front of the back part, in order to enhance transfer of loads onto the pelvic girdle. Although satisfactory for carrying heavy loads, this solution does not focus on or improve the elimination of sweat from the back during carrying.

The invention lessens these drawbacks.

SUMMARY OF THE INVENTION

The invention refers to a system for carrying articles on one's back and, more particularly, a backpack, in which, during carrying, it is possible satisfactorily to eliminate the sweat which forms on the carrier's back while combining better conditions of comfort and respect for the morphology of the carrier's back.

This system for carrying articles on one's back, consisting:

of a load carrier integral with a back part;

of a carrying harness including a waist strap and shoulder straps fastened to the bottom and to the top of the back part;

and of a rigid frame in the form of an inverted U, formed from two bent branches fastened to the back part of the load carrier, to the top of the back part at the height of the portion connecting the two branches of the U and to the bottom of the back part, respectively, interacting with the waist strap, is one wherein the end part of each of the two branches of the rigid U-shaped frame is formed from two coupled branches forming a downward-facing upturned V:

a first branch intended to interact with the bottom of the back part;

a second branch intended to interact with the rear face of the waist strap, respectively, so as to provide a space between the bottom of the back part of the load carrier and the rear face of the waist strap.

In other words, the invention consists in providing, at the bottom of the back part, i.e. at the location where places of contact with the carrier's back are greatest, a volume of air which thus guarantees, by means of a chimney effect, satisfactory ventilation of the back, particularly at the waist, i.e. at the location where, as is known, the essential part of the load is carried and where the sweating phenomena are greatest.

Advantageously, in practice:

the inverted U-shaped rigid frame has an ergonomic curved form, the branches of which have a flattened cross section;

the first branch and the second branch, defining the upturned V, are arranged substantially in the same plane and in a symmetrical manner;

the end portion of each first branch of the V is housed in a sleeve provided for this purpose at the bottom of the back part;

the end part of each second branch is secured to a rigid plate arranged in the lumbar region, the plate being fastened to the rear face of the waist strap, arranged opposite the back part;

this rigid plate is made from plastic and has a plurality of raised aligned deformations which face the back part and form a retention piece for receiving and enclosing the end portion of the second branch;

each free end of the U-shaped rigid frame interacts with an independent piece consisting of two branches forming the V, one of these branches being intended for insertion into the sleeves provided at the bottom of the back part, the other of these branches being intended for insertion into the retention pieces of the rigid plate, the free end of the U-shaped frame also being inserted into these retention pieces;

when the bottom of the load carrier rests on the ground, the end of the second branch projects beyond the end of the first branch to form a stand.

In order not to modify balance excessively during carrying, the distance between the bottom of the two branches of the upturned V, which interacts with the U-shaped frame, is of the order of from one to three centimeters, advantageously of the order of two centimeters. It follows that the carrier's back will be aerated and ventilated essentially upward in order thus to eliminate the sweat and heat at shoulder level and on the sides.

In a variant, the lower end of the space provided between the waist strap and the back part of the load carrier may comprise a mesh-type fabric to enhance and trigger the chimney effect.

As already stated, the invention is particularly useful in its application to backpacks.

It may also be successfully used for other systems for carrying articles on one's back, such as child carriers, carrying racks or satchels.

The way in which the invention may be embodied and the advantages ensuing therefrom will become more apparent from the following illustrative embodiment, with reference to the appended figures.

EMBODIMENT OF THE INVENTION

Figure 1:
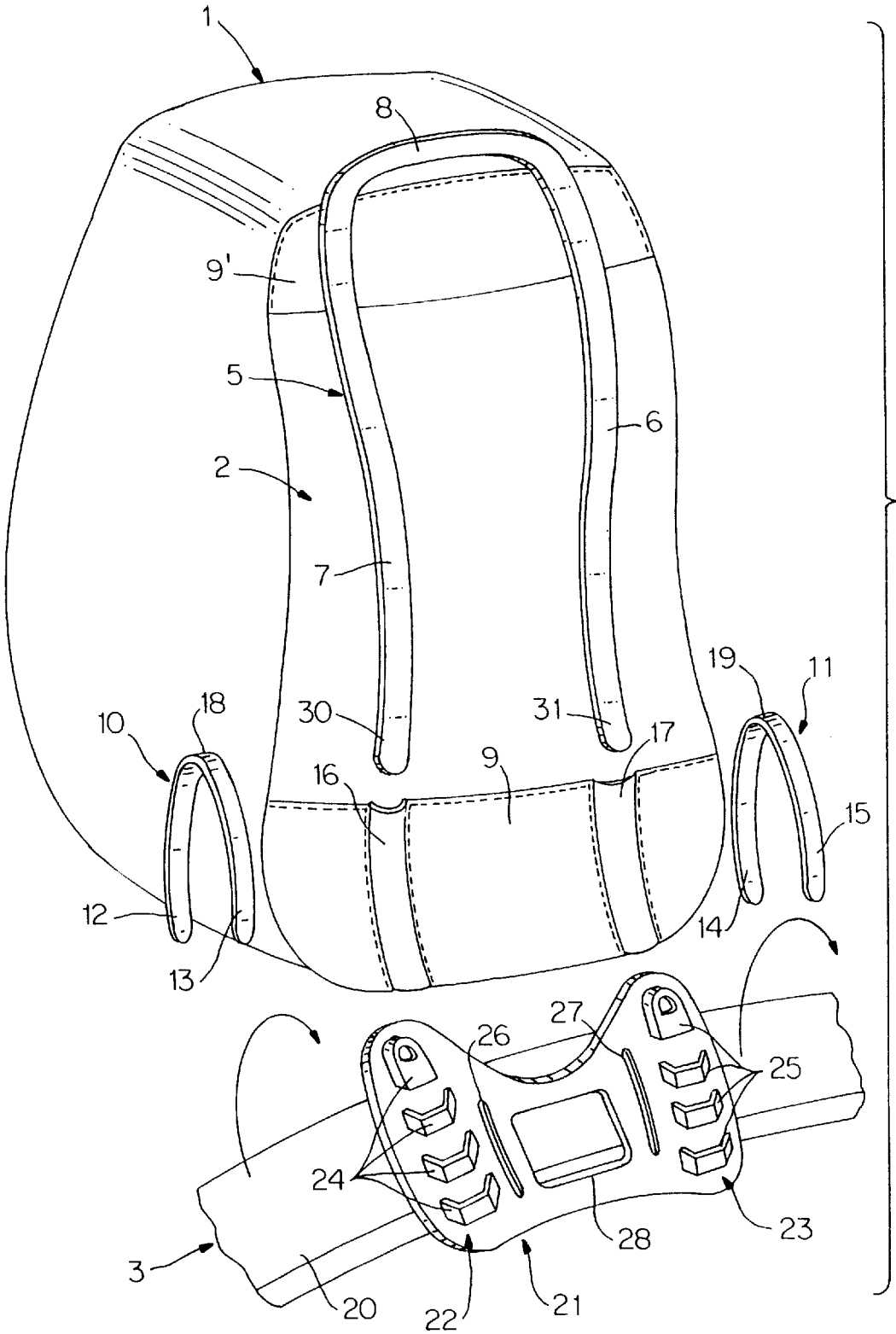
FIG. 1 is an exploded rear view in summary perspective of a backpack according to the invention.

The invention relates to a backpack consisting of an actual bag (1) intended to receive the load. This bag is integral with a back part (2) and a conventional carrying harness formed from two shoulder straps (not shown) fastened to the top of the back part (2), respectively, and a waist strap (3).

This backpack (1) also comprises a rigid frame in the form of an inverted U, denoted by reference (5), formed from two bent branches (6) and (7), respectively, for example made from flattened aluminum tube. This rigid inverted U-shaped frame (5) advantageously follows an ergonometric curved form. These two branches (6) and (7) are connected together at the top of the back part via a connection portion (8) inserted into a pocket (9') provided for this purpose at the top of the back part (2). This rigid frame (5) may be incorporated actually inside the back part (2) if the latter is, for example, thermoformed.

Figure 2:
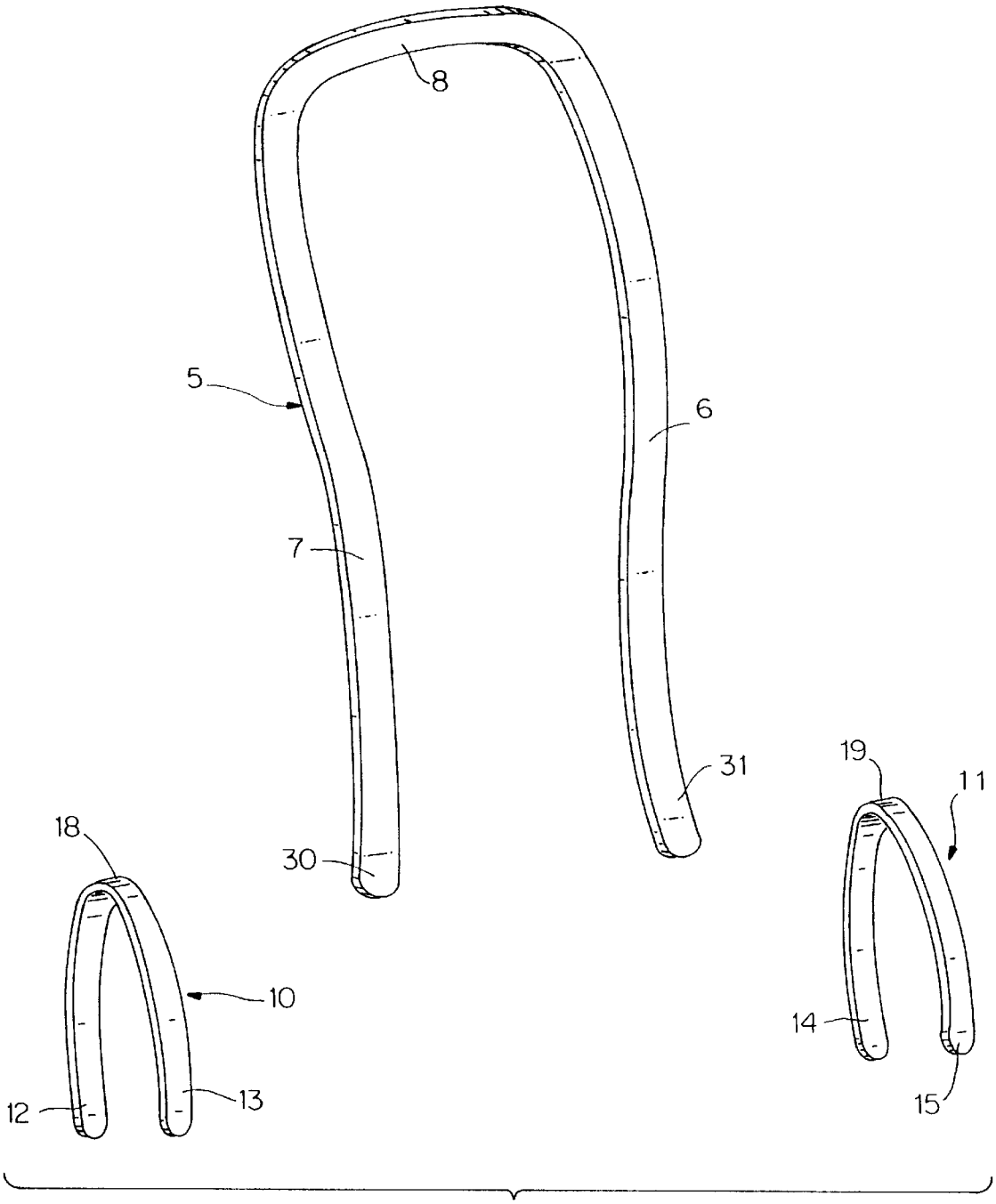
FIG. 2 is a diagrammatic representation in summary perspective of the characteristic rigid frame associated with the characteristic spacers of the invention.
Figure 3:
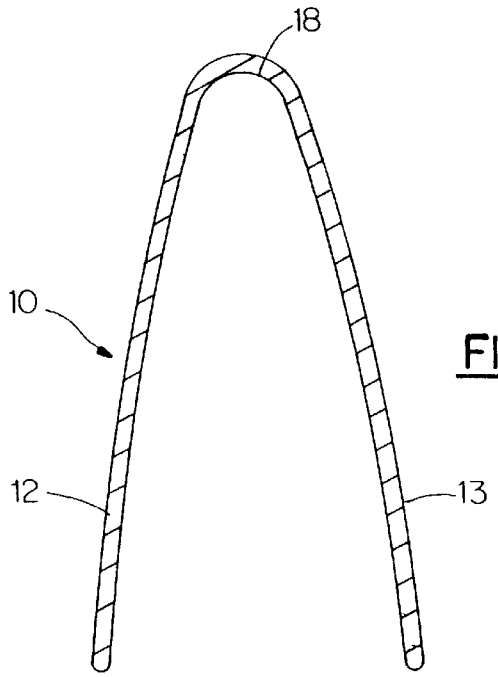
FIG. 3 is a sectional representation of the characteristic upturned-V end part.

According to a first characteristic of the invention, the entire carrying system also comprises two independent monoblock pieces (10) and (11), respectively, in the form of an upturned V (see FIGS. 2 and 3), which are hereinafter denoted spacers. These spacers in the form of an upturned V, whose opening faces downward, are formed from two substantially identical branches (12, 13, 14, 15), respectively, which are optionally bent (see FIG. 1), made, for example, from steel. References (18, 19) denote the top of the V-shaped spacers.

According to a characteristic of the invention, the first branches (12, 14) are intended for interacting with the bottom (9) of the back part, more specifically by insertion into sleeves (16, 17), respectively, provided for this purpose at the bottom of the back part.

The branches (12–15) of the spacers (10, 11) are substantially arranged in the same plane.

Figure 4:
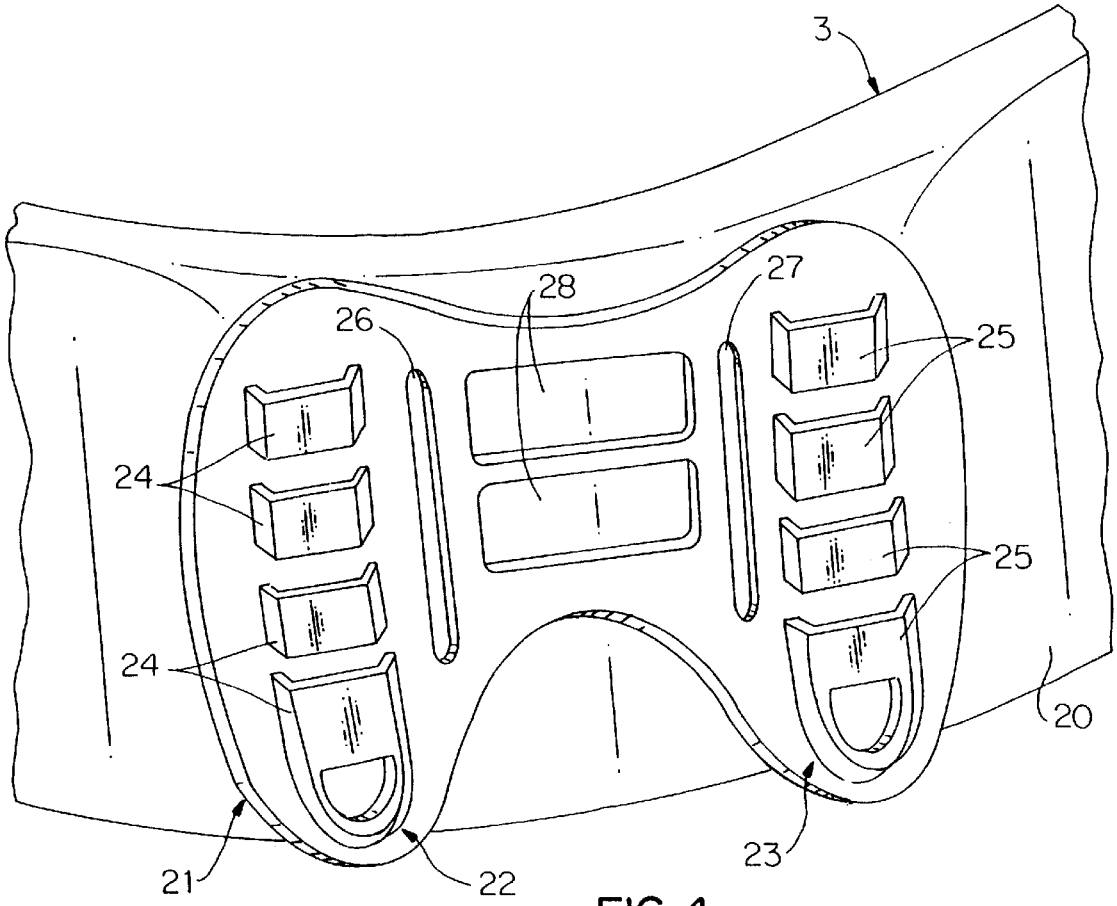
FIG. 4 is a diagrammatic representation of the characteristic rigid carrying plate fastened to the rear face of the waist strap.

The second branches (13, 15) of the spacers (10, 11) are intended for interacting with the rear face (20) of the waist strap (3) and, more precisely (see FIGS. 1 and 4), with a rigid plate (21) made from plastic arranged in the lumbar region, this plate being itself fastened to the rear face (20) of the waist strap (3), arranged opposite the bottom (9) of the back part. This rigid plate (21), which participates in the carrying action after the fashion of the teachings described in document FR-A-2 700 677 of the Applicant, has two pluralities (22, 23) of aligned raised deformations facing toward the bottom (9) of the back pack forming a retention piece (24, 25). These aligned retention pieces (24, 25) are intended for receiving and enclosing the second branches (13–15) of the spacers and for receiving the end extremities (30–31) of the branches (6, 7) of the curved U-shaped rigid frame (5). The references (26, 27) (see FIG. 4) denote lines of stitching for fastening the rigid plate made, for example, from injected low-density polyethylene which is therefore easy to sew in the rear face (20) of the waist strap. Reference (28) denotes open portions intended for lightening and ventilating the entire system.

Implementation is as follows.

Figure 5:
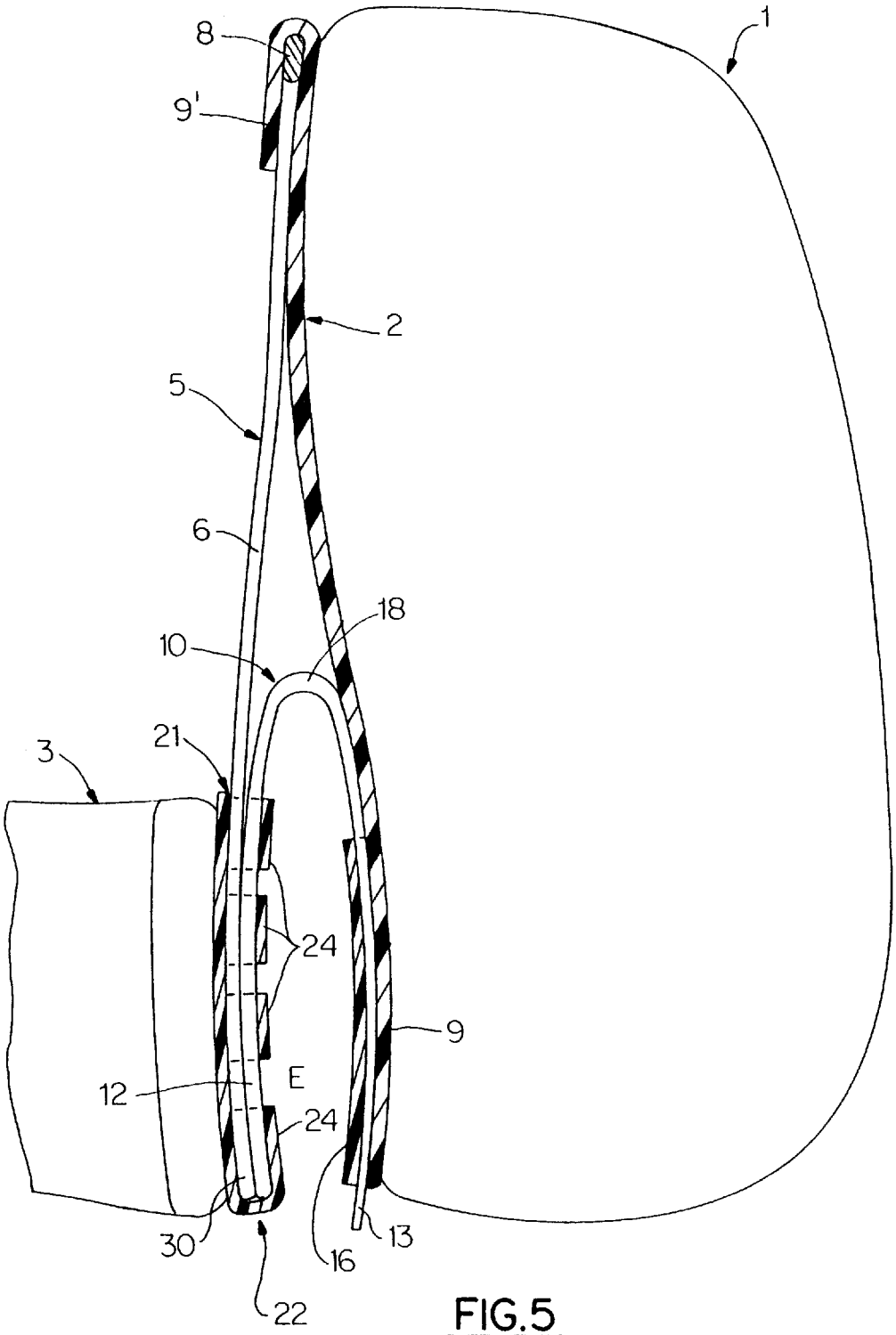
FIG. 5 is a representation in longitudinal section of a backpack according to the invention.
Figure 6:
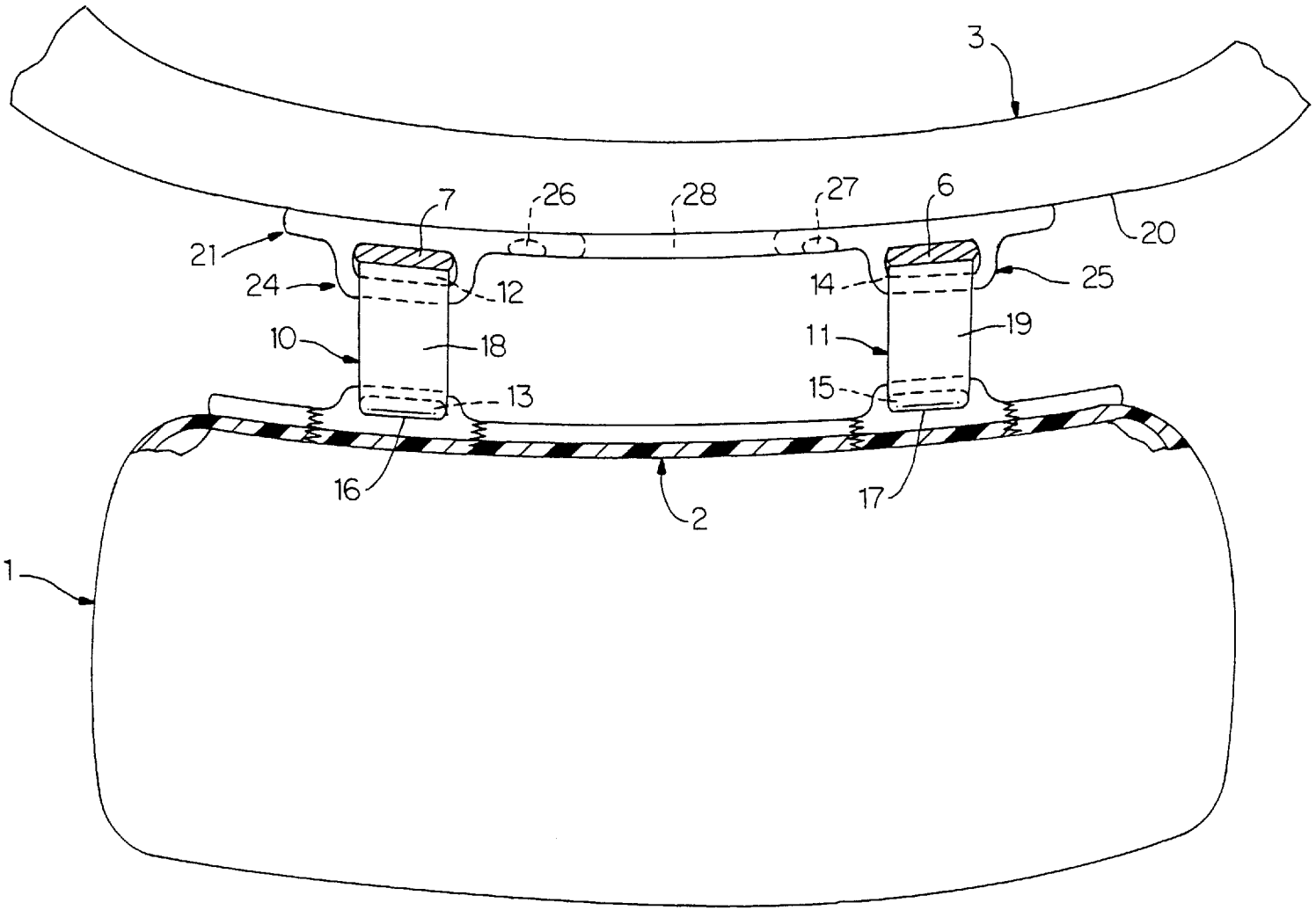
FIG. 6 is a representation in transverse section of a backpack according to the invention.

Firstly, each of the two ends (30) and (31) of the U-shaped frame (5) is slipped into the respective retention pieces (24, 25) of the rigid piece (21), arranged at lumbar level, sewn to the rear face (20) of the waist strap (3). The branch (13) of the spacer (10) is then forcibly inserted into these same retention pieces, superposed over the ends (30) and (31), as is the branch (15) of the spacer (11) also, advantageously made from steel flat. The second branch (12, 14) of these spacers is then inserted into the respective sleeves (16, 17) of the bottom (9) of the back part (2). To block the spacers (10, 11) in position in the retention pieces (24, 25), it is possible, advantageously, to make provision for the use of pins or screws or any other similar means (not shown). In this way, when the bag is in place on the carrier's back, as may be seen in FIG. 5, a space (E), open toward the bottom and on the sides, is provided at the bottom of the back part, creating a space between the external face of the waist strap which is thus pressed against the carrier's back and the internal face of the back part (2) of the actual bag. This space (E) promotes ventilation and thereby the formation of a "chimney" effect which is exerted essentially upward and thus eliminates sweat and heat right down the back part and on the side.

In another embodiment, the spacer device according to the invention may also apply in connection with the characteristic linking piece which is capable of sliding along two bent branches arranged at shoulder-blade height for adjustment of the shoulder straps, as described in French Application FR 96.02293, filed by the Applicant on Feb. 20, 1996.

The backpack according to the invention thus makes it possible advantageously to eliminate the essence of the drawbacks which are due to sweat and caused by contact between the back part of the bag and the carrier's back, particularly by virtue of the chimney effect which guarantees permanent ventilation. Moreover, the rigid frame guarantees transfer of the weight onto the waist strap and therefore the load remains close to the carrier's back. Genuine comfort in use is thus achieved.

We claim:

1. A system for carrying articles on one's back, comprising:

a load carrier (1) integral with a back part (2) of a carrying harness, said harness including a waist strap (3) and shoulder straps, respectively fastened to the bottom (9) and the top (9') of the back part;

a rigid frame (5) shaped in the form of an inverted U having a connecting portion (8) and two bent branches (6,7) extending therefrom sized for fastening to the top (9') and to the bottom (9') of the back part of the load carrier, respectively, each of said bent branches having end parts (30,31) respectively engageable with two auxiliary coupling branches (12–15), each said auxiliary branch forming a downward-facing V and including:

a first auxiliary branch (12,14) for engaging with the bottom (9) of the back part; and a second auxiliary branch (13,15) for engaging with a rear face (20) of the waist strap (3), respectively, defining a space (E) between the bottom (19) of the back part (2) of the load carrier and the rear face (20) of the waist strap (3).

2. The carrying system as claimed in claim 1, wherein the inverted U-shaped rigid frame (5) has an ergonomic curved form, the branches (6,7) having a substantially flattened cross section.

3. The carrying system as claimed in claim 1, wherein the first auxiliary branch (12,14) and the second auxiliary branch (13,15) are arranged substantially in the same plane and in a symmetrical manner.

4. The carrying system as claimed in claim 1, wherein an end portion of each first auxiliary branch (12, 14) is housed in a sleeve (16,17) provided at the bottom (9) of the back part.

5. The carrying system as claimed in claim 1, wherein an end part of each second auxiliary branch (13,15) is secured to a rigid plate (21) arranged in the lumbar region of a wearer, the plate being fastened to the rear face (20) of the waist strap (3), arranged opposite the bottom (9) of the back part.

6. The carrying system as claimed in claim 5, wherein the rigid plate (21) is made from plastic and includes two series (22,23) of raised aligned deformations (24,25) facing the back part and forming a retention piece sized for receiving and enclosing the end portion of each second auxiliary branch (13,15).

7. The carrying system as claimed in claim 6, wherein each end part (30,31) of the U-shaped rigid frame (5) interacts with an independent piece (10,11), which forms a spacer, said spacer consisting of said two auxiliary coupling branches (12, 13, 14, 15) forming the V, one of these auxiliary branches (12,14) being intended for insertion into respective sleeves (16,17) provided at the bottom of the back part, the other of these auxiliary branches (13,15) being intended for insertion into the retention pieces (24,25) of the rigid plate, into which said free end parts (30,31) of the branches (6,7) of the U-shaped rigid frame are also inserted.

8. The carrying system as claimed in claim 1, wherein said system forms a backpack.

* * * * *